US005136996A

United States Patent [19]

Kushi et al.

[11] Patent Number: 5,136,996

[45] Date of Patent: Aug. 11, 1992

[54] IGNITION SYSTEM AND METHOD FOR INTERNAL COMBUSTION ENGINE

[75] Inventors: Naoto Kushi; Toshikazu Ibaraki, both of Toyota, Japan

[73] Assignee: Toyota Jidosha Kabushiki Kaisha, Aichi, Japan

[21] Appl. No.: 703,483

[22] Filed: May 21, 1991

[30] Foreign Application Priority Data

May 22, 1990 [JP] Japan ..... 2-131606
Apr. 15, 1991 [JP] Japan ..... 3-82571

[51] Int. Cl.[5] ..... F02D 33/00
[52] U.S. Cl. ..... 123/332
[58] Field of Search ..... 123/332, 198 OB, 333, 123/481; 180/197, 76; 364/426.01

[56] References Cited

U.S. PATENT DOCUMENTS 4,573,440 3/1986 Pischke et al. ..... 123/333
5,018,595 5/1991 Hara et al. ..... 123/332
5,025,881 6/1991 Poiriar et al. ..... 180/197

FOREIGN PATENT DOCUMENTS 104730 6/1985 Japan ..... 123/332
170754 1/1987 Japan ..... 123/332

*Primary Examiner*—Raymond A. Nelli
*Attorney, Agent, or Firm*—Kenyon & Kenyon

[57] ABSTRACT

An ignition system is provided for an internal combustion engine in which an amount of fuel necessary for combustion during one combustion and expansion stroke in one cycle of the internal combustion engine is injected toward respective cylinders, and the fuel is sucked, together with air, into the cylinders during respective suction strokes. The engine has a fuel cut control in which a fuel injection is cut off when the internal combustion engine is working under a predetermined condition. The ignition system includes a first unit for igniting mixtures of fuel and air in the respective cylinders in respective combustion and expansion strokes, and a second unit for detecting a cylinder into which the amount of fuel necessary for combustion has not yet been sucked completely when the fuel cut control ends. Also, the ignition system includes a third unit for controlling the first unit so that the mixture of fuel and air in the cylinder specified by the second unit is prevented from being ignited. There is also provided an ignition method.

22 Claims, 12 Drawing Sheets

IGNITION SYSTEM AND METHOD FOR INTERNAL COMBUSTION ENGINE

BACKGROUND OF THE INVENTION (1) Field of Invention

The present invention generally relates to ignition systems for an internal combustion engine, and more particularly to an ignition system for an internal combustion engine which carries out a fuel cut control.

(2) Description of Related Art

As is well known, a conventional fuel injection control for an internal combustion engine employs a control such that a fuel cut is carried out when the internal combustion engine is working under a predetermined condition. An automotive vehicle equipped with a traction control system (frequently referred to as a TRC system) is known. The traction control system suppresses a wheel spin caused by, for example, an excessive driving force when the vehicle starts to move and accelerate on a snow-covered road, in order to ensure the stability of a vehicle traveling direction and appropriate vehicle driving force. The traction control system can be realized by various methods. For example, a fuel cut control directed to reducing the engine output power to suppress the wheel spin (see Japanese Laid-Open Patent Application No. 62-170754 and No. 60-104730).

An internal combustion engine employing such a fuel cut control has a problem in that if the fuel cut is terminated at an inadequate restoration timing, the combustion and expansion stroke will start under the condition where an appropriate amount of fuel for combustion has not yet been sucked into a cylinder or cylinders of the engine. For example, an internal combustion engine designed to have a necessary amount of fuel by injecting fuel twice has the following problem. If the first fuel injection is carried out during the time the fuel cut control is being carried out and the second fuel injection is carried out after the fuel cut control is terminated, the combustion and expansion stroke will start in a state where a cylinder has the fuel injected during only the second fuel injection. In this case, the combustion and expansion stroke is performed where a combustion room has an amount of fuel half the amount of fuel necessary for combustion. That is, the combustion and expansion stroke is carried out for a lean air-fuel ratio mixture.

When the air-fuel mixture is lean, it takes a long time to burn the air-fuel mixture and a live charcoal remains in the next suction (intake) stroke. In this case, the air-fuel mixture burns in the next suction stroke, so that back-fire occurs and drivability deteriorates greatly.

SUMMARY OF THE INVENTION

It is a general object of the present invention to provide an ignition system and method for an internal combustion engine in which the above-mentioned disadvantages are eliminated.

A more specific object of the present invention is to prevent the occurrence of back fire arising from combustion of a lean air-fuel mixture.

The above-mentioned objects of the present invention are achieved by an ignition system for an internal combustion engine in which an amount of fuel necessary for combustion during one combustion and expansion stroke in one cycle of the internal combustion engine is injected toward respective cylinders, and the fuel is sucked, together with air, into the cylinders during respective suction strokes, and the internal combustion engine has a fuel cut control in which a fuel injection is cut off when the internal combustion engine is working under a predetermined condition, the ignition system comprising:

a first unit for igniting mixtures of fuel and air in the respective cylinders in respective combustion and expansion strokes;

a second unit for detecting a cylinder into which the amount of fuel necessary for combustion has not yet been sucked completely when the fuel cut control ends; and a third unit for controlling the first unit so that the mixture of fuel and air in the cylinder specified by the second unit is prevented from being ignited.

The aforementioned objects of the present invention are also achieved by an ignition method for an internal combustion engine in which an amount of fuel necessary for combustion during one combustion and expansion stroke in one cycle of the internal combustion engine is injected toward respective cylinders, and the fuel is sucked, together with air, into the cylinders during respective suction strokes, and the internal combustion engine having a fuel cut control in which a fuel injection is cut off when the internal combustion engine is working under a predetermined condition, the ignition method comprising the steps of:

(a) igniting mixtures of fuel and air in the respective cylinders in respective combustion and expansion strokes;

(b) detecting a cylinder into which the amount of fuel necessary for combustion has not yet been sucked completely when the fuel cut control ends; and (c) preventing the step (a) from igniting the mixture of fuel and air in the cylinder detected by the step (b).

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1:
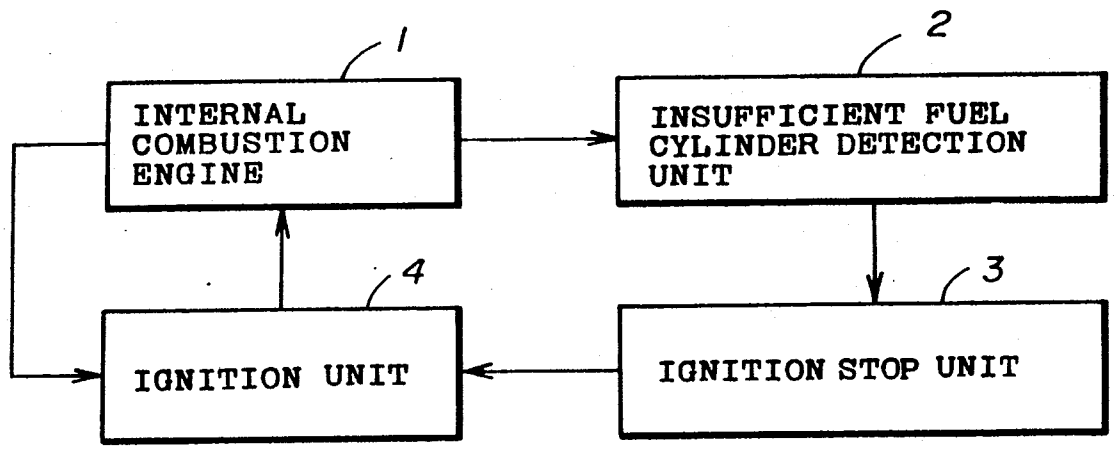
FIG. 1 is a block diagram showing the principle of the present invention.

Referring to FIG. 1, an ignition system according to the present invention includes an insufficient-fuel cylinder detection unit 2, an ignition stop unit 3, and an ignition unit 4. These units are operatively coupled to an internal combustion engine 1. Normally, the ignition unit 4 sequentially ignites air-fuel mixtures in cylinders of the internal combustion engine 1 at ignition timings. An amount of fuel necessary for complete combustion during one combustion and expansion stroke in one cycle of the internal combustion engine 1 is injected toward all the cylinders at the same time or toward some cylinders in a group unit. The injected fuel is sucked, together with air, into the cylinders during the respective suction strokes. Then, the air-fuel mixture sucked into each cylinder is ignited in the combustion and expansion stroke. A fuel cut control is executed when the internal combustion engine 1 is working under a predetermined condition.

The insufficient-fuel cylinder detection unit 2 detects a cylinder into which an amount of fuel necessary for combustion in one combustion and expansion stroke has not yet been sucked when the fuel cut is terminated. The ignition stop unit 3 controls the ignition unit 4 so that the fuel-air mixture is prevented from being sucked into the cylinder detected by the insufficient-fuel cylinder detection unit 2. With this arrangement, it is possible to prevent the ignition unit 4 from igniting each cylinder into which the amount of fuel necessary for combustion during one combustion and expansion stroke has not yet been sucked. Thus, the lean air-fuel mixture is not ignited, so that back fire can be prevented from taking place.

Figure 2:
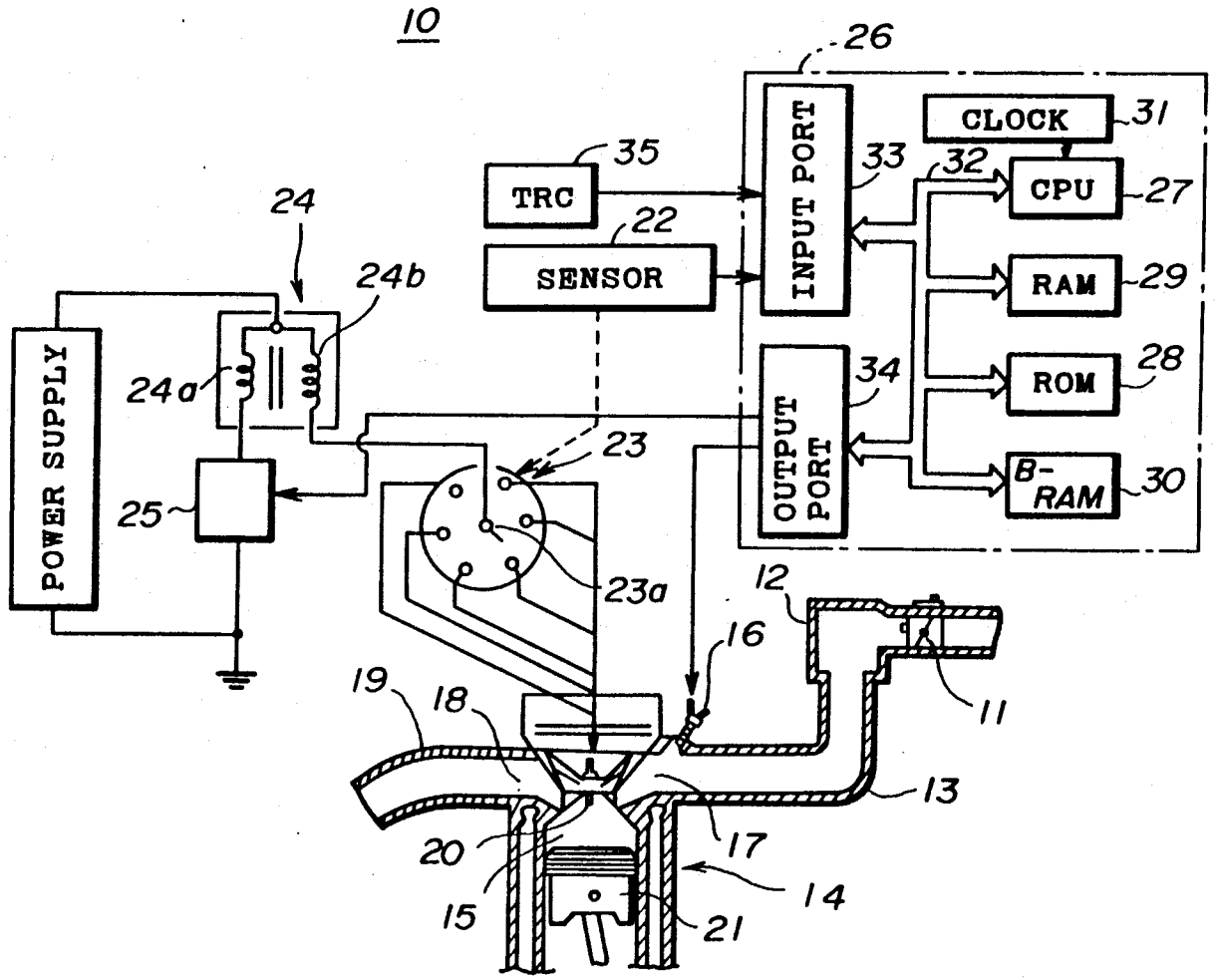
FIG. 2 is a diagram of an internal combustion engine equipped with an ignition system according to a first preferred embodiment of the present invention.

FIG. 2 shows an essential part of an internal combustion engine 10 equipped with the ignition system according to the first preferred embodiment of the present invention. The engine 10 is a six-cylinder four-cycle spark ignition type engine for a vehicle, and is controlled by a microcomputer 26, which will be described in detail later. Fuel is simultaneously injected once toward each of the six cylinders in one revolution of the engine 10, and each of the cylinders is filled with an amount of fuel necessary for combustion in one combustion and expansion stroke by injecting fuel twice. That is, an amount of fuel necessary for combustion is injected twice in one cycle of the engine 10.

The structure of the engine 10 will now be described with reference to FIG. 2. The engine 10 has a throttle valve 11. A surge tank 12 and an intake manifold 13 are provided on the downstream side of the throttle valve 11. The intake manifold 13 is coupled to a combustion room 15 of an engine main body 14 via an intake port 17. A fuel injection valve (injector) 16 is provided in the intake manifold 13 in such a way that a part of the fuel injection valve 16 projects from an inner wall of the intake manifold 13. The fuel injection valve 16 injects fuel into air flowing in the intake manifold 13.

The combustion room 15 is coupled to a catalytic converter (not shown) via an exhaust port 18 and an exhaust manifold 19. An ignition plug 20 is provided so that a part of the ignition plug 20 projects in the combustion room 15. The ignition timing of the ignition plug 20 is controlled by the ignition system which will be described later. A piston 21 reciprocates in up and down directions.

A turning angle sensor 22 for detecting the revolution of the engine 10 (engine speed) is provided. The turning angle sensor 22 detects the revolution of a shaft 23*a* of a distributor 23, and generates an engine speed (NE) signal at, for example, every 30° crankshaft angle. The engine speed signal is output to a microcomputer 26. The distributor 23 generates an ignition signal synchronized with the strokes of the engine 10, and a high-voltage signal generated by an ignition coil 24 is sequentially distributed to the six ignition plugs by controlling the ignition signal. The ignition coil 24 has a primary coil 24*a* and a secondary coil 24*b*. By controlling the time during which a primary current is passing through the primary coil 24*a* and controlling the time at which the primary current is cut off, the above-mentioned high-voltage signal for igniting the ignition plug 20 is developed across the secondary coil 24*b*.

The operation of the ignition coil 24 is controlled by an ignitor 25, which is electrically connected to the microcomputer 26. The passage and cutoff of the primary current is controlled by the ignitor 25 in accordance with a control signal generated and output by the microcomputer 26. The ignitor 25 also varies the passage time during which the primary current is passing through the primary coil 24*a*.

The microcomputer 26 includes a central processing unit (MPU) 27, a read only memory (ROM) 28, a random access memory (RAM) 29, a battery backup random access memory (B-RAM) 30, a clock generator 31, a bidirectional bus 32, an input port 33 and an output port 34. The ROM 28 stores programs executed by the CPU 27. The RAM 29 functions as a work area of the CPU 27, and the backup RAM 30 stores data even after the engine is turned OFF. The clock generator 31 supplies a master clock to the CPU 27. The bidirectional bus 32 couples the above-mentioned structural elements of the microcomputer 26 to each other. The input port 33 receives signals from the turning angle sensor 22 and a traction control unit 35, and outputs the signals to the bidirectional bus 32. The output port receives signals from the bidirectional bus 32 and outputs the signals to the ignitor 25 and the injector 16. Although other sensors are actually coupled to the microcomputer 26, these sensors do not play an important role in the present invention and thus are omitted for the sake of simplicity.

The present invention is directed towards determining the timing of stopping ignition at the beginning of the fuel cut and timing of starting ignition at the end of the fuel cut. In the first embodiment of the present invention, the fuel cut starts and ends in response to a fuel cut request signal generated and output by the traction control unit 35. As has been indicated previously, the traction control realized by the traction control unit 35 is directed to preventing the occurrence of a wheel spin caused by an excessive driving force when a vehicle starts to move and accelerate on a snow-covered road in order to ensure the stability of a vehicle traveling direction and appropriate vehicle driving force.

Figure 3:
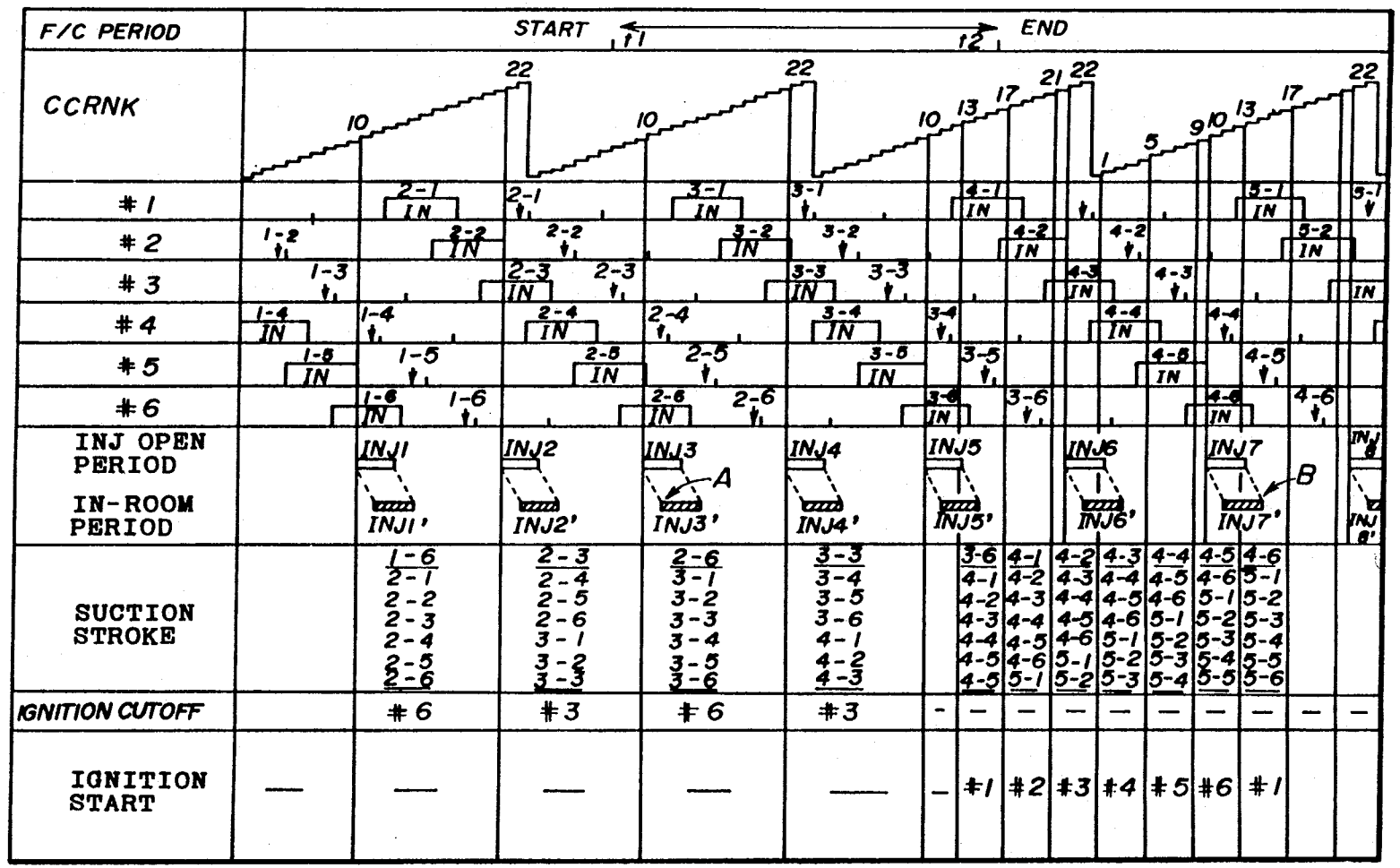
FIG. 3 is a time chart showing the operational principle of the ignition system according to the first embodiment of the present invention.

A description will now be given of the operational principle of the ignition system according to the present invention with reference to FIG. 3, which is a timing chart showing the timings of the fuel injection and ignition with respect to the engine 10. In FIG. 3, CCRNK denotes the count value in a counter (also referred to as CCRNK) which counts 23 during a crankshaft angle of 720° and is reset after the count value has become equal to 23. "IN" shown in FIG. 3 shows, out of the four strokes of the engine 10, the suction (intake) stroke and "↓" indicates ignition timing.

The ranges indicated by INJ1 through INJ8 denote periods in which the injector 16 is open. The fuel injection is executed when the count value CCRNK is equal to "10" or "22". It takes a slight time for fuel injected by the injector 16 to reach the combustion room 15. With the above in mind, the periods in which the fuel is actually in the combustion room 15 are indicated by INJ1' through INJ8' shown below INJ1 through INJ8. Each column showing the fuel suction shows the order of the suction strokes which are carried out during a predetermined period defined by the count value CCRNK. It will be noted that the periods INJ'1–INJ8' during which the fuel is actually in the combustion rooms 15 vary in accordance with the working state of the engine 10.

According to the first embodiment of the present invention, neither fuel injection nor ignition is carried out during the execution of the fuel cut. If the injection control is not suitably carried out, a lean air-fuel mixture will be ignited, so that back fire will take place. In order to eliminate such a problem, the timing of the suction stroke in each of the cylinders is compared with the in-room periods INJ1'–INJ8'. If there is a cylinder which has not yet been filled with the amount of fuel necessary for combustion during one combustion and expansion stroke, the ignition procedure is not carried out for such a cylinder.

As has been indicated previously, fuel is simultaneously injected into each cylinder once in one revolution of the engine 10, and thus the amount of fuel necessary for combustion is obtained by injecting fuel twice. With the above-mentioned fuel injection procedure in mind, the injection stop timing at the beginning of the fuel cut and the timing of starting the injection at the end thereof will be described later.

A description will now be given of a procedure for determining a cylinder in which the act of stopping the fuel injection starts at the beginning of the fuel cut. Stopping the fuel injection at the beginning of the fuel cut is carried out as follows. The first step is to detect a cylinder in which all fuel injected once is not completely sucked after the fuel cut request signal is generated and output by the traction control unit 35. That is, the suction stroke during which all fuel injected once is not completely sucked into the combustion room 15 is detected. The second step is to sequentially stop the ignition, starting from the detected cylinder.

It will be noted that suction strokes subsequent to the detected suction stroke during which all fuel injected once is not completely sucked make lean air-fuel ratios. On the other hand, suction strokes prior to the detected suction stroke fill the combustion rooms 15 with an amount of fuel necessary for combustion.

FIG. 3 shows the fuel cut which is continuously carried out between time $t_1$ and $t_2$ shown in a column showing the fuel cut (F/C) period. The aforementioned fuel cut request signal is continuously input during the period between time $t_1$ and $t_2$. The first fuel injection timing after time $t_1$ is INJ3. Thus, the fuel injection is stopped starting from fuel injection INJ3. Then, a suction stroke which produces a lean air-fuel mixture resulting from stoppage of the fuel injection is detected. For example, this procedure detects a cylinder for which the suction stroke is being carried out at the beginning of the in-room period INJ3' (indicated by A in FIG. 3). In the case shown in FIG. 3, suction stroke 2-6 meets the above-mentioned condition. Intake strokes subsequent to suction stroke 2-6 produce lean air-fuel mixtures. Thus, the ignition is stopped starting from the sixth cylinder. Thereby, the ignition for cylinders provided with lean air-fuel mixtures produced due to the execution of the fuel cut is stopped, so that the occurrence of back fire can be prevented and improved drivability at the time of starting the fuel cut control can be obtained.

In FIG. 3, a underlined suction stroke during which stroke the fuel injected by each of the fuel injections INJ1–INJ4 is not completely sucked into the corresponding combustion room 15. Four columns related to ignition cutoff show cylinders from which the ignition is cut off when the fuel cut starts within the periods INJ1–INJ4. If the fuel cut starts from the fuel injection which starts when the count value CCRNK is 10, the cylinder from which the ignition is cut off is the sixth cylinder. If the fuel cut starts from the fuel injection which starts when the count value CCRNK is 22, the cylinder from which the ignition is cut off is the third cylinder. Thus, by detecting the count values CCRNK corresponding to the starting times of the in-room periods INJ1'–INJ8', it is possible to automatically specify the cylinders from which the ignition cutoff should be started.

A description will now be given of the procedure for determining a cylinder from which the ignition should be started after the end of the fuel cut. In order to start the ignition after the fuel cut is terminated, it is necessary for the combustion room 15 to be completely filled with the amount of fuel necessary for combustion during one combustion and expansion stroke when it is ignited. Since the necessary amount of fuel is separately injected twice in one cycle, it is required that all fuel injected twice be completely sucked into the combustion room 15 at an ignition timing after the fuel cut control ends. Thus, in order to determine a cylinder from which the ignition starts, it is sufficient to detect the first cylinder which has been completely filled with the twice injected fuel by the end of the in-room period (any of the INJ1'–INJ8') of the second injection which is carried out after the fuel cut control ends.

The fuel-cut request signal goes off at time $t_2$. In this case, the first injection after time $t_2$ is fuel injection INJ6, and the second injection thereafter is fuel injection INJ7. Taking into account the relationship between the end of INJ7' and each suction stroke, suction stroke 4-6 does not suck all fuel injected during INJ7' and suction stroke 5-1 is the first stroke which can suck all fuel injected during INJ7'.

Each underlined suction stroke is a stroke detected based on the above-mentioned procedure in which all fuel is not completely taken. The time chart is divided into a plurality of sections in a four-count unit of the counter CCRNK corresponding to the suction stroke (a crankshaft angle of 120°), and is assumed that the end of the in-room period is obtained in each of the suctions.

In the present embodiment, the fuel cut is terminated at time $t_2$, and thus the end of the in-room period INJ6' related to the first fuel injection timing is within the range between CCRNK1–CCRNK5, and the end of the in-room period INJ7' related to the second fuel injection timing is within the range between CCRNK13–CCRNK17. Thus, the fuel injected by the first fuel injection is entirely sucked starting from suction stroke 4-4, and the fuel by the second fuel injection is completely sucked starting from suction stroke 5-1 (symbol "●" is attached thereto). Thus, all fuel by the first and second fuel injections is completely sucked starting from suction stroke 5-1. As a result, it is concluded that the ignition should be started from the first cylinder after the end of the fuel cut.

FIG. 3 shows the ignition starting cylinders obtained when the ends (indicated by "B") of the in-room periods fall in the various ranges of the counter values CCRNK. It is possible to determine the ignition starting cylinders on the basis of the relationships between the ends of the in-room periods and the count value in the counter CCRNK, as shown in Table 1.

TABLE 1

| Range of CCRNK | Ignition Starting Cylinder |
|---|---|
| CCRNK1–4 | #4 |
| CCRNK5–8 | #5 |
| CCRNK9–12 | #6 |
| CCRNK13–16 | #1 |
| CCRNK17–20 | #2 |
| CCRNK21–0 | #3 |

A description will now be given of the operation of the ignition system comprising the turning angle sensor 22, the distributor 23, the ignition coil 24, the ignitor 25, the microcomputer 26 and so on, with reference to FIGS.4 and 5. The procedures (programs) shown in FIGS.4 and 5 are registered in the ROM 28, and are executed in response to an interrupt which occurs for every 30° crankshaft angle (NE interrupt).

Figure 4:
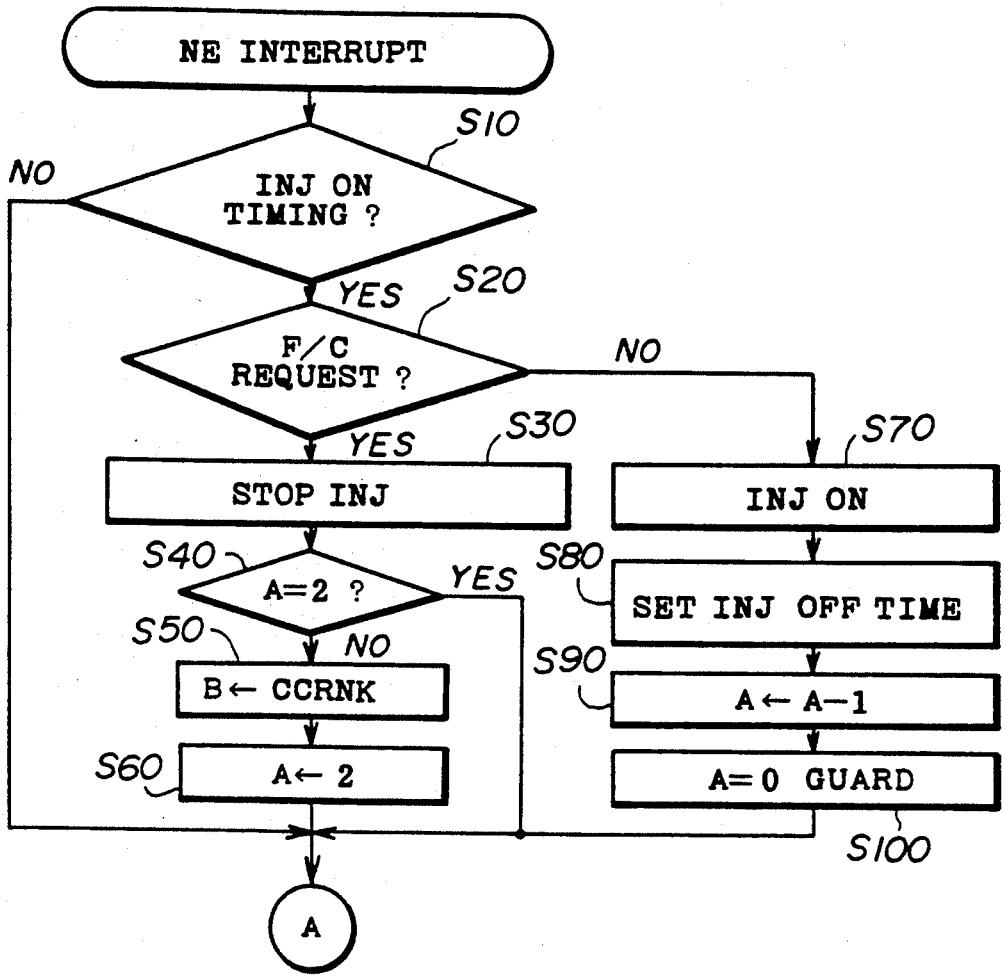
FIG. 4 is a diagram illustrating the operation of the ignition system according to the first embodiment of the present invention.
Figure 5:
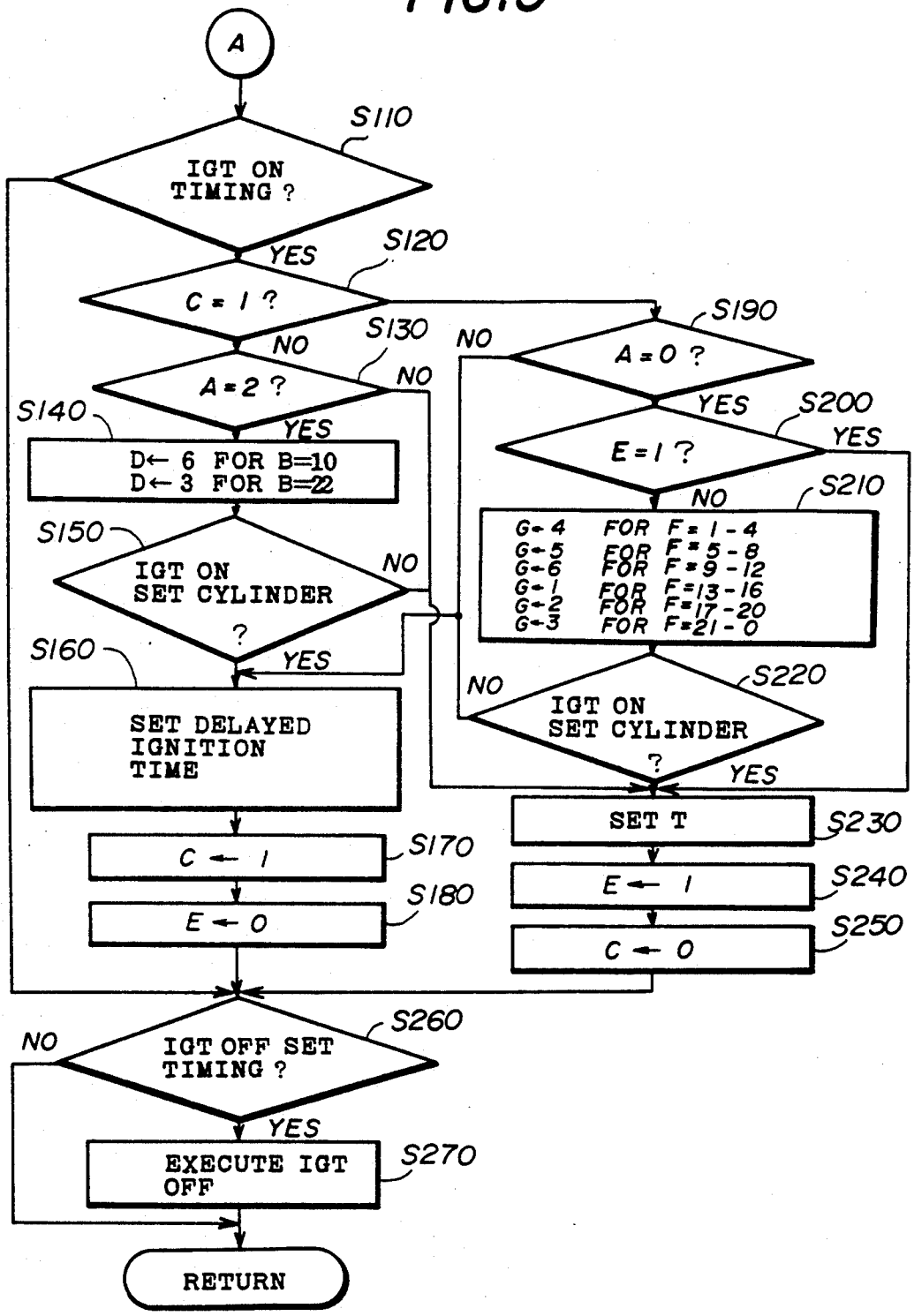
FIG. 5 is a diagram illustrating the operation of the ignition system according to the first embodiment of the present invention.

After the routine shown in FIG. 4 is activated, at step S10, the CPU 27 determines whether or not the timing of the current interrupt coincides with the fuel injection timing (INJ ON timing). As has been indicated previously, the fuel is injected when the count value CCRNK is equal to 10 or 22. Thus, at step S10, the CPU 27 determines whether or not the current timing corresponds to either CCRNK10 or CCRNK22.

If the result obtained at step S10 is YES, at step S20 the CPU 27 determines whether or not the fuel cut (F/C) request signal is being supplied from the traction control unit 35. When the result at step S20 is YES, the CPU 27 recognizes that the ignition system is performing the fuel cut control. On the other hand, when the result at step S20 is NO, the CPU 27 recognizes that the normal ignition procedure is being carried out. When it is determined, at step S20, that the fuel cut request signal is being supplied, the CPU 27 stops the fuel injection (INJ).

At step S40, the CPU 27 judges whether or not a flag A representative of the state of the fuel cut control is equal to 2. The flag A is equal to 2 when the fuel cut control is being carried out, and equal to 1 when the first fuel injection has been performed after the end of the fuel cut. When the fuel injection has been performed twice after the end of the fuel cut, the flag A is equal to 0. When it is judged, at step S40, that A is not equal to 2, the CPU 27 executes step S50, at which step the current value in the counter CCRNK, B, is stored in the RAM 29. At step S60 subsequent to step S50, the CPU 27 sets the flag A to 2.

On the other hand, when it is determined, at step 20, that there is no fuel cut request signal, the CPU 27 executes step S70, at which step the CPU 27 makes the injector 16 open (INJ ON), so that the fuel injection is started. After starting the fuel injection at step S70, at step S80 the CPU 27 writes, into a compare register, the end time of the fuel injection (INF OFF) based on a fuel injection time (TAU) which has already been calculated based on the current engine condition in a main routine in a conventional way. At step S90, the CPU 27 decrements the value of the flag A by 1, and at step S10, guards the flag A so that it becomes smaller than 0. When the result at step S40 is YES, or when the procedure of step S60 or step S100 ends, the CPU 27 executes step S110 shown in FIG. 5.

The procedure from step S10 to step S100 shown in FIG. 4 stops the fuel injection based on the execution of the fuel cut and sets the flag A. The first routine performed after starting the fuel cut (at this time, the flag A is equal to 1) executes the steps S10, S20, S30, S40, S50, S60 and S110 in this order, and the second routine (at this time, the flag A is equal to 2) executes the steps S10, S20, S30, S40 and S110 in this order. The routine executes steps S10, S20, S70, S80, S90, S100 and S110 in this order (A=0 in each routine after the second execution of the procedure).

A procedure that starts from step S110 will be described below. The procedure from step S120 to step S180 stops the ignition, and the procedure from step S190 to Step S250 restarts the ignition.

Figure 7:
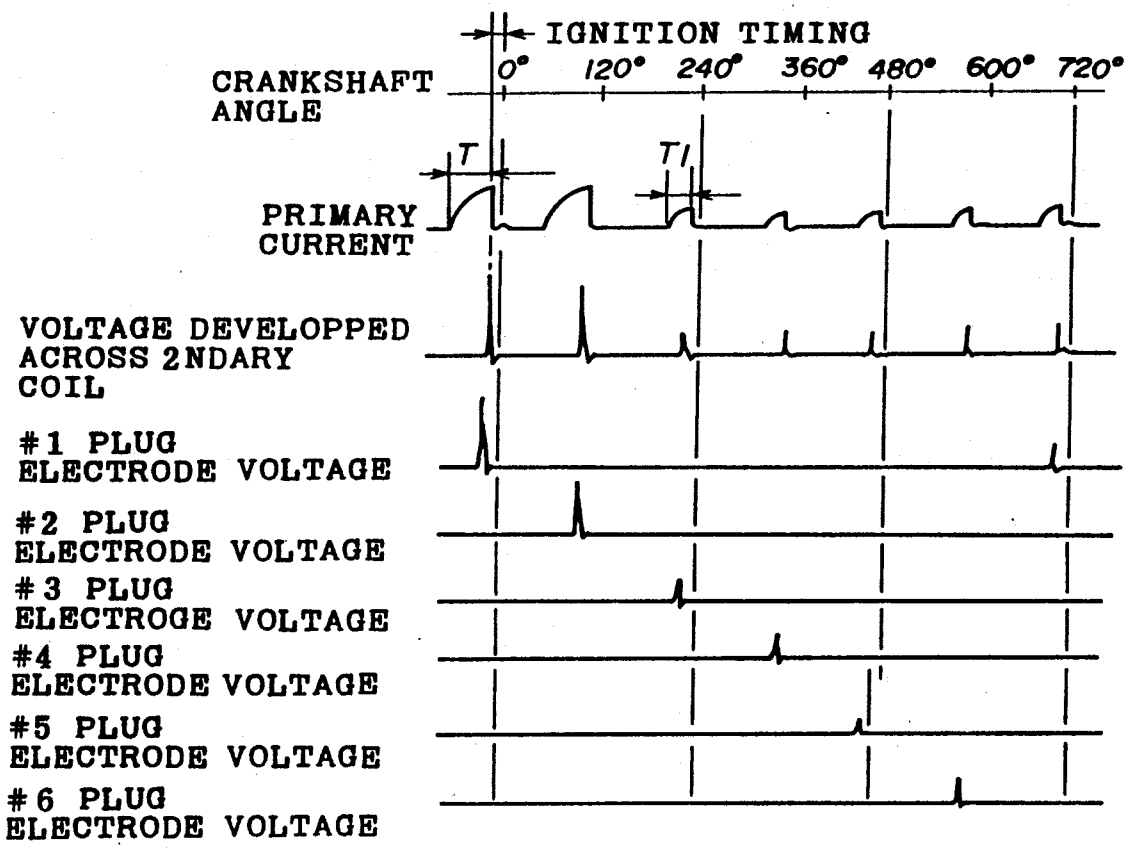
FIG. 7 is a diagram illustrating the operation of an ignition coil.

At step S110, the CPU 27 judges whether or not the primary current should now be allowed to pass through the primary coil 24*a* of the ignition coil 24 (IGT ON). As shown in FIG. 7, the ignition coil 24 is controlled so that the primary current passes through the primary coil 24*a* for a predetermined time T. When the predetermined time T has elapsed, the supply of the primary current is stopped. At this time, a high voltage is developed across the secondary coil 24*b* of the ignition coil 24. This high voltage is applied to the ignitor 25, which is turned ON.

When the result obtained at step S110 is YES, the CPU 27 executes step S120, at which step it discerns whether or not a flag C is equal to 1. The flag C is set to 1 when the ignition was not performed in the previous routine, and reset to 0 when the ignition was performed in the previous routine. When the result obtained at step S120 is NO, the CPU 27 executes step S130, at which step it judges whether or not the flag A is equal to 2. When the result obtained at step S130 is YES, the CPU 27 executes step S140. The state in which the result at step S120 is negative and the result at step S130 is affirmative shows that the ignition was carried out in the previous routine and the fuel cut is being executed. That is, this state is such that the ignition should be stopped. At step S140, the CPU 27 determines from which cylinder the ignition should be stopped. Step S140 is based on the aforementioned procedure for determining a cylinder from which stoppage of ignition should start at the beginning of the fuel cut. That is, if the value B in the counter CCRNK is equal to 10 at the beginning of the fuel injection, the ignition is stopped starting from the sixth cylinder. If the value B is equal to 22, the ignition is stopped starting from the third cylinder 3. The number of the cylinder detected in the above-mentioned way, now labeled D, is stored in the RAM 29 (FIG. 2).

At subsequent step S150, the CPU 27 determines whether or not the present time coincides with the time at which the distributor 23 applies the high voltage to the cylinder D. When the result obtained at step S150 is YES, the CPU 27 executes step S160.

In order to reduce the ignition-ON time during which the primary current is passing through the primary coil 24a and thereby cut off the ignition, at step S160 a delayed ignition time is set. The procedure at step S160 will now be explained with reference to FIG. 7, which shows the case where the cylinder from which the ignition should be stopped is the third cylinder.

In order to execute the normal ignition, the ignitor 25 passes the primary current through the primary coil 24a of the ignition coil 24 during the time T. At the end of the time T, the supply of the primary current is abruptly stopped, so that a voltage high (or period long) enough to turn ON the ignition plug 20 is developed across the secondary coil 24b. When stoppage of the ignition is stopped, the current is allowed to pass through the primary coil 24a during a time T1 shorter than the time T, so that a voltage insufficient to turn ON the ignition plug 20 is developed across the secondary coil 24b. With this arrangement, it is possible to prevent the ignition plug 20 from being ignited.

It should be noted that the action of stopping the ignition is realized without stopping the supply of the primary current passing through the primary coil 24a at all. The CPU 27 performs a conventional self-diagnostic procedure of determining whether or not the ignition is normally carried out. If no current is allowed to pass through the primary coil 24a, the CPU 27 will judge that a fault has occurred in the ignition system.

Turning now to FIG. 5, after the starting time at which the supply of the current passing through the primary coil 24a is determined, the CPU 27 sets the flag C to 1 at step S170, and resets a flag E to zero at step S180. During the time when the ignition is made inactive, the flag E is equal to 0. On the other hand, when the ignition is being carried out, the flag E is equal to 1. After executing the steps S170 and S180, the CPU 27 executes step S260.

On the other hand, when the result at step S120 is YES, that is, when the ignition is made inactive in the previous execution of the routine, the procedure proceeds to step S190, at which step the CPU 27 determines whether or not the flag A is equal to 0. When it is determined, at step 190, that A=0, that is, when the fuel injection has been carried out twice after the fuel cut control is terminated, the CPU 27 determines whether or not the flag E is equal to 1 at step S200. If the result obtained at step S200 is negative, the CPU 27 executes step S210. When the results obtained at the steps S120 and S190 are YES and the result at step S200 is NO, the ignition is still maintained in the inactive state although the fuel cut has already been terminated and the fuel injection has been carried out twice after the end of the fuel cut. That is, this state is such that the ignition should now be started.

When it is determined that the ignition should now be started by the steps S120, S190 and S200, the CPU 27 executes step S210, at which step it specifies one cylinder from which the ignition should be started. Step S120 is based on the aforementioned procedure for determining a cylinder from which the ignition should be started after the end of the fuel cut. That is, the cylinder from which the ignition should be started is determined based on the value in the counter CCRNK (hereafter this counter value is indicated by F) obtained at the end of the fuel-in-room period. More specifically, the relationship between the ignition starting cylinder and F is as shown in Table 2.

TABLE 2

| Cylinder | F |
|---|---|
| #4 | 1–4 |
| #5 | 5–8 |
| #6 | 9–12 |
| #1 | 13–16 |
| #2 | 17–20 |
| #3 | 21–0 |

The number of the specified cylinder, now labeled G, is stored in the RAM 29.

Figure 6:
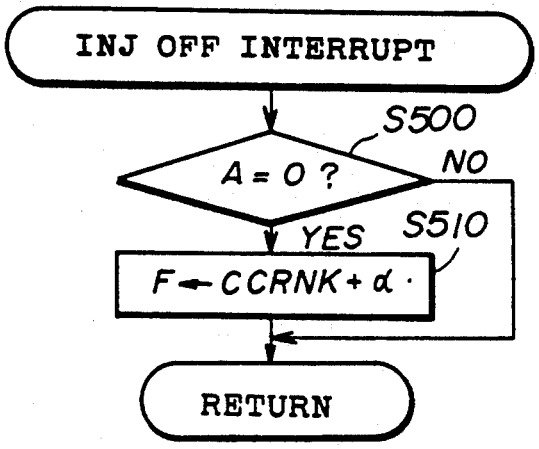
FIG. 6 is a diagram showing a procedure for obtaining a count value in a counter CCRNK obtained when the fuel injection ends.

The value F in the counter CCRNK is obtained from an interrupt routine shown in FIG. 6 activated when the fuel injection ends. More specifically, the routine shown in FIG. 6 is activated when the value F becomes equal to the end time of the fuel injection registered in the register at step S80 so that a signal INJ OFF is output. The end time of the fuel injection can be calculated in a conventional way.

At step 500 shown in FIG. 6, the CPU 27 determines whether or not the flag A is equal to 0. When the result obtained at step S500 is YES, that is, when the fuel injection has been carried out twice after the end of the fuel cut, the CPU 27 executes step S510, at which step a coefficient $\alpha$ is added to the current value in the counter CCRNK and the added result is stored in the RAM 29. As has been described previously, there is a slight time difference between the end of the fuel injection and the end of the in-room period. The coefficient $\alpha$ compensates for the above time difference. The value F in the counter CCRNK is not calculated during the time the fuel cut is being carried out (A=2) and the first fuel injection after the end of the fuel cut (A=1) is carried out since it is not necessary to specify the injection starting cylinder. The value F in the counter CCRNK thus calculated is registered in the register in the RAM 29 at step S80, and maintained therein until the aforementioned output signal INJ OFF is generated.

Turning now to FIG. 5, after step S210, the CPU 27 determines, at step S220, whether or not the current operating timing coincides with the timing at which the distributor 23 applies the high voltage to the cylinder G. When the result at step S220 is YES, the CPU 27 executes step S230, at which step the current passage time T during which the primary current passes through the primary coil 24a is set. Then, the ignitor 25 passes the primary current through the primary coil 24a during the time T, and then the ignition plug 25 is ignited.

In the above-mentioned way, the ignition is restarted from the cylinder which has sucked the fuel injected twice after the end of the fuel cut. It will be noted that the ignition starting cylinder is filled with the amount of fuel necessary for combustion during one combustion and expansion stroke. With the above-mentioned arrangement, it is possible to prevent the ignition from starting from a cylinder filled with a lean air-fuel mixture and thus prevent the occurrence of back fire. This leads to an improvement in drivability.

After starting the ignition at step S230, the CPU 27 sets the flag E to 1 at step S240 and resets the flag C to 0 at step S250. Then, the CPU 27 executes step S260.

On the other hand, when the result at step S130 or step S150 is negative, the CPU 27 performs step S230, at which step the normal ignition procedure is carried out. More specifically, the normal ignition procedure is carried out when it is determined, at step S130, that the fuel has not yet been injected twice after the end of the fuel cut or when it is determined, at step S150, that there is no cylinder from which the ignition should be restarted. When it is determined, at step S200, that the ignition has already been started, step S210 is not needed, so that the CPU 27 immediately performs step S230.

When the result at step S190 or step S220 is NO, the CPU 27 executes step S160, at which step it stops the advancing ignition. That is, the ignition must be maintained in the inactive state when it is determined, at step S190, that the fuel cut control is being carried out or the first fuel injection after the end of the fuel cut is being (or has been) carried out, or when it is then determined, at step S220, that there is no cylinder from which the ignition should be started.

When it is determined, at step S110, that the current time does not coincide with the timing at which the current is allowed to pass through the primary coil 24*a* of the ignition coil 24, or when the process at step S180 or step S250 is completed, the CPU 27 executes step S260. It is determined, at step S260, whether or not the current operating time coincides with the time when the primary current passing through the primary coil 24*a* should be cut off (IGT OFF). When the result obtained at step S260 is YES, the CPU 27 executes step S270, at which step the cutoff time of the primary current is set. When step S270 is completed, the high voltage is developed across the secondary coil 24*b* (see FIG. 7).

A description will now be given of a second preferred embodiment of the present invention. The internal combustion engine 10 used in the second embodiment is a four-cylinder, four-cycle spark ignition type engine. In the second embodiment, the first and third cylinders form one group (hereafter referred to as a first group), and the second and fourth cylinders form a second group (hereafter referred to as a second group).

Figure 13:
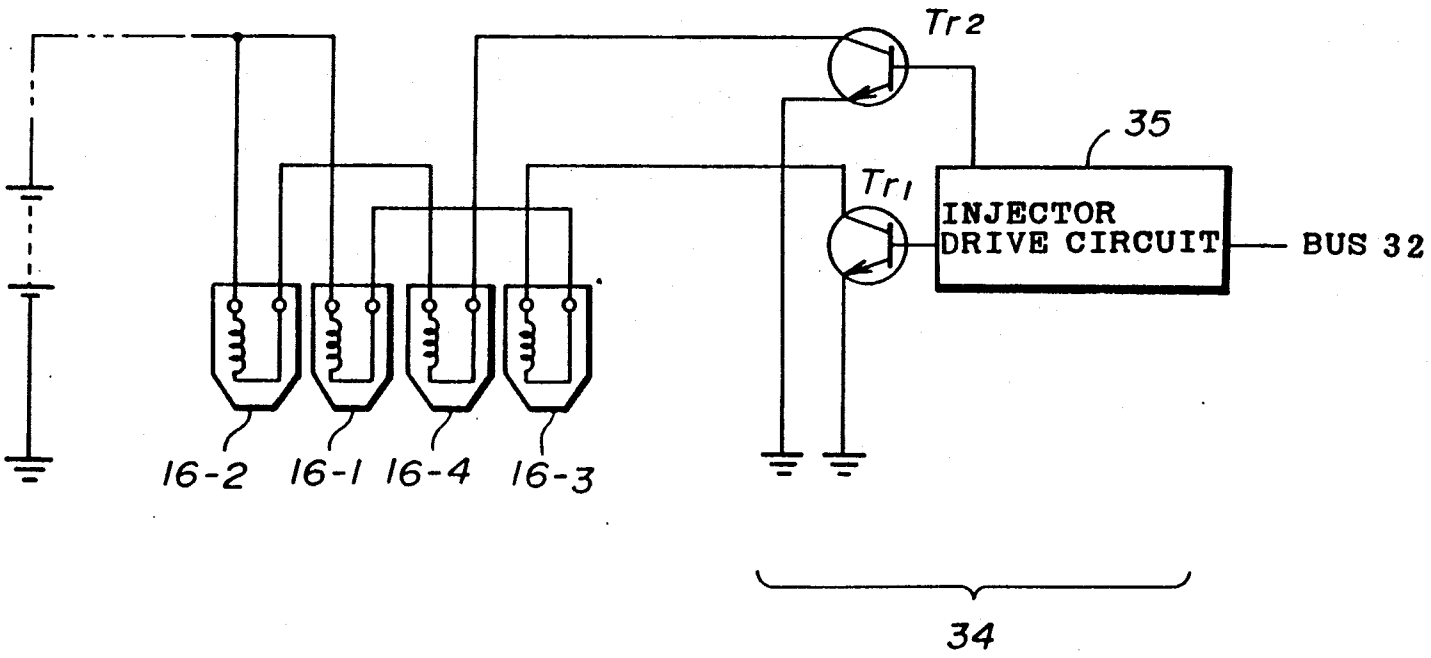
FIG. 13 is a circuit diagram of a peripheral circuit coupled to four injectors used in the second embodiment of the present invention.

As shown in FIG. 13, four injectors (fuel injection valves) 16-1, 16-2, 16-3 and 16-4 are provided for the respective intake manifolds coupled respectively to the four cylinders. The first and third injectors 16-1 and 16-3 are controlled b a first transistor Tr1, and the second and fourth injectors 16-2 and 16-4 are controlled by a second transistor Tr2. The first and second transistors Tr1 and Tr2 are driven by an injector driving circuit 35, which is provided in the output port 34. When the first transistor Tr1 is turned ON, the first and third injectors 16-1 and 16-3 are driven at the same time. When the second transistor Tr2 is turned ON, the second and fourth injectors 16-2 and 16-4 are driven at the same time.

It will be noted that the second embodiment of the present invention mainly differs from the aforementioned first embodiment as regards the fuel injection process and the ignition timing control executed by the microcomputer 26. This means that the hardware structure of the first embodiment shown in FIG. 2 can be almost the same as that of the second embodiment. Thus, the hardware structure of the second embodiment is now omitted, and a description will be given of only the fuel injection process and the ignition timing control according to the second embodiment.

Figure 8:
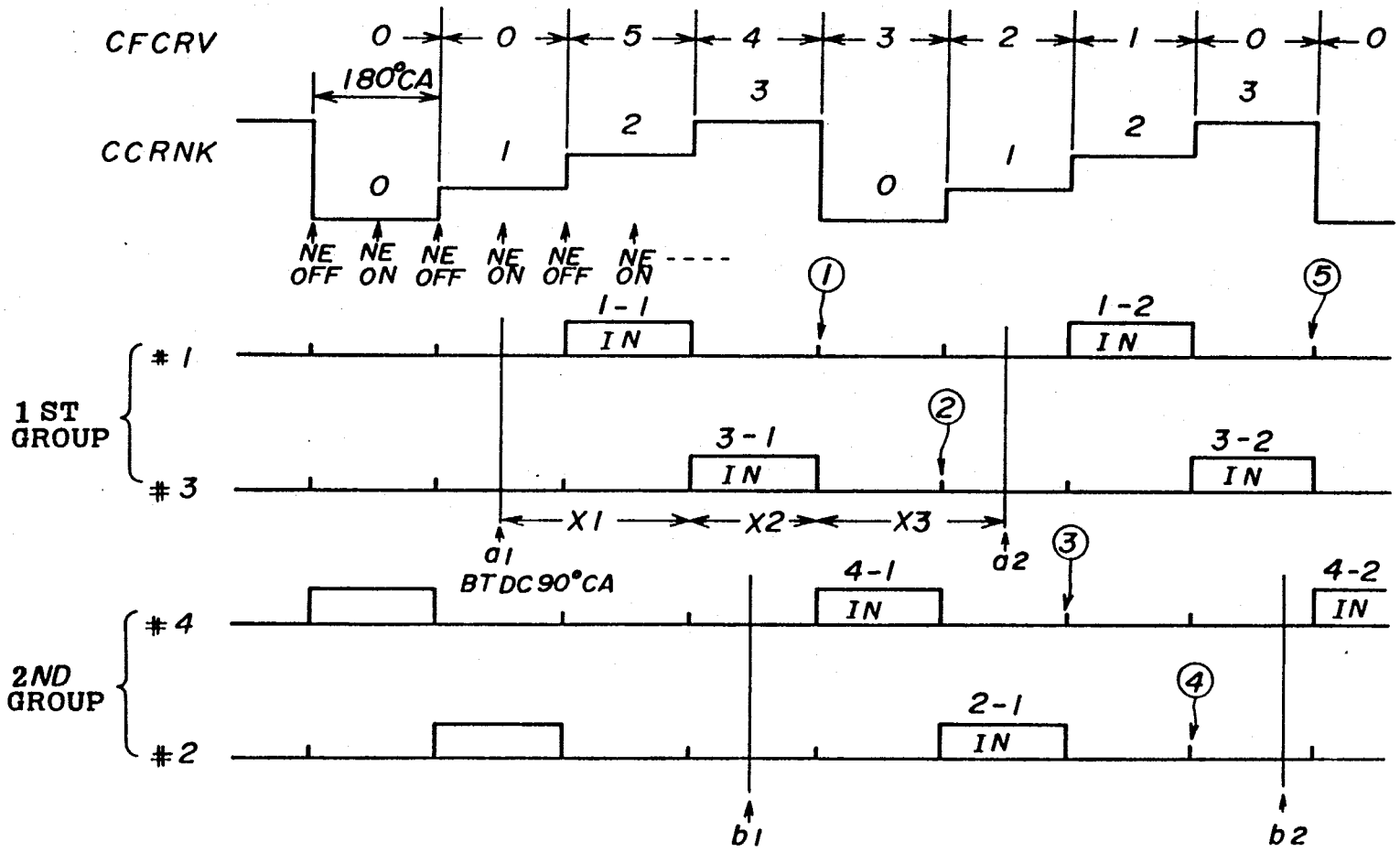
FIG. 8 is a time chart showing the operational principle of an ignition system according to a second preferred embodiment of the present invention.

FIG. 8 shows the fuel injection procedure and ignition procedure according to the second embodiment. The counter CCRNK used in the second embodiment counts 4 starting from 0 during a crankshaft angle (CA) of 720° corresponding to one cycle, and is then reset to 0. That is, the counter CCRNK outputs 0, 1, 2, 3, 0, 1, . . . in this order. "IN" in FIG. 8 denotes the suction stroke, and ①-⑤ the ignition timings.

For the sake of convenience, a description will be given of only the control of the first group consisting of the first and third cylinders. The fuel cut control ends at time $a_1$ from which time the fuel injection starts. As is well known, the amounts of fuel sucked into the respective cylinders are different from each other due to the respective timings of the suction strokes related to the cylinders and the times of the ends of the fuel injections. With the above in mind, the following three cases will be described separately. These three cases are such that the end time of the fuel injection which starts from time $a_1$ is (i) within a period X1, (ii) within a period X2 and (iii) within a period X3.

A description will now be given of the first case where the fuel injection ends within the period Xl. In the first case, the suction stroke 1-1 of the first cylinder and the suction stroke 3-1 of the third cylinder can suck all the fuel injected. Thus, by starting the ignition at the ignition timing ① the air-fuel mixture taken in both the first and third cylinders can be completely burned.

In the second case where the fuel injection ends within the period X2, suction stroke 1-1 of the first cylinder has not yet been completed when the intake valve (not shown for the sake of simplicity) is closed. That is, the fuel injection still continues when the intake valve is closed. Under this condition, if the ignition is started from the ignition timing ①, lean combustion takes place in the first cylinder, so that back fire may occur. For this reason, the ignition is not started at the time ① when the end of the fuel injection falls within the period X2. On the other hand, the third cylinder is filled with all the fuel injected. Thus, the ignition is started from the third cylinder, so that the occurrence of back fire can be prevented.

In the third case where the fuel injection ends within the period X3, neither suction stroke 1-1 of the first cylinder nor suction stroke 3-1 of the third cylinder has not yet ended when the intake value is closed. Thus, neither the first cylinder nor the third cylinder is filled with the amount of fuel necessary for combustion. Even if the ignition is started from time ②, lean combustion will take place in the first and third cylinders, so that back fire may occur. In order to eliminate the above disadvantage, the ignition is not carried out at times ① and ②, but started from the first cylinder in which fuel injected by the next fuel injection performed at time $a_2$ is entirely sucked. Thus, the air-fuel mixture is ignited at the ignition timing ⑤.

The above-mentioned procedure for the first and third cylinders also holds true for the second and fourth cylinders.

A description will now be given of the operation of the ignition system according to the second embodiment, which includes the turning angle sensor 22, the distributor 23, the ignition coil 24, the ignitor 25 and the microcomputer 26, with reference to FIGS. 9 through 11.

Figure 9:
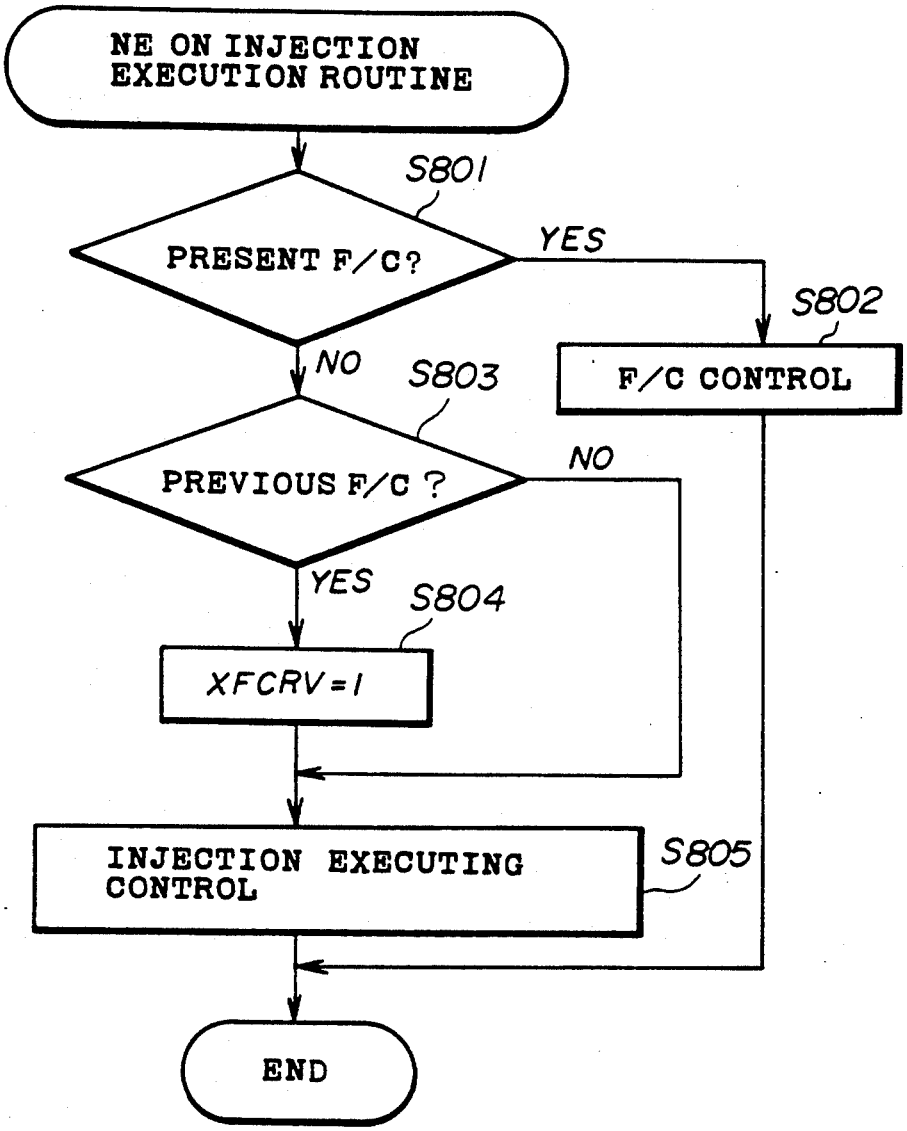
FIG. 9 is a diagram illustrating the operation of the ignition system according to the second embodiment of the present invention.
Figure 12:
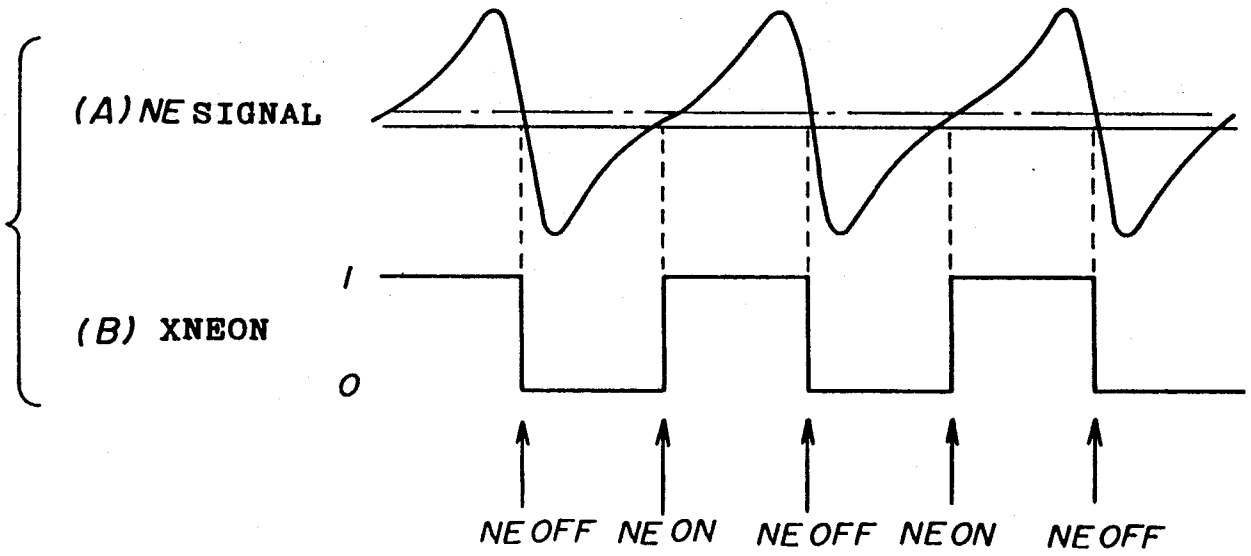
FIG. 12 is a diagram showing an NE ON interrupt and NE OFF interrupt.

FIG. 9 shows a fuel injection executing routine, which is activated in response to the revolution number signal (engine speed signal; NE signal) output by the turning angle sensor 22 provided for the distributor 23. Although the NE signal has a waveform as shown in FIG. 12(A), it is shaped into a rectangular waveform pulse signal XNEON (FIG. 12(B)) through a waveform shaping device (not shown for the sake of simplicity) provided in the input port 3 (FIG. 3) in a conventional way. The fuel injection executing routine shown in FIG. 9 is an interrupt routine which is activated in synchronism with each rise of the pulse signal XNEON (this interrupt routine is referred to as an NE ON interrupt routine).

After the fuel injection executing routine is activated, at step S801, the CPU 27 determines whether or not the fuel cut control is being carried out in the routine being processed. When the result at step S801 is YES, the CPU 27 executes step 802, at which step it executes the fuel cut control. On the other hand, when the result at step S801 is NO, the CPU 27 executes step 803, at which step it determines whether or not the fuel cut control was executed in the immediately previous routine. When the result at step S803 is YES, the CPU 27 executes step S804, at which step it sets a flag XFCRV to 1. At subsequent step S805, the CPU 27 executes the fuel injection control. On the other hand, when the result at step S803 is NO, step S804 is bypassed and step S805 is directly carried out.

That is, the fuel injection executing routine shown in FIG. 9 continues to execute the fuel cut control when the fuel cut control is being carried out, and executes the fuel injection control when it is determined that the fuel cut control has been terminated. Further, when it is determined by the steps S801 and S803 that the routine being processed is the first execution of the routine after the end of the fuel cut control, the flag XFCRV is set to 1.

A description will now be given of an NE OFF interrupt routine shown in FIGS. 10 and 11. This routine defines a procedure for determining the ignition starting time, and is activated in synchronism with each fall of the pulse signal XNEON (this routine is referred to as NE OFF interrupt routine).

After the NE OFF interrupt routine is activated, at step S901 the CPU 27 increments (or resets) the value in the counter CCRNK. As shown in FIG. 8, the counter CCRNK sequentially and repeatedly counts four starting from zero (0, 1, 2 and 3). At subsequent step S902, the CPU 27 decrements the count value in a counter CFCRV by 1. The counter CFCRV is guarded so that it counts a value smaller than zero. The counter CFCRV will be described in more detail later.

At step S903, the CPU 27 determines whether or not the flag XFCRV is equal to 1. The flag XFCRV is set to 1 at step S804 of the fuel injection executing routine shown in FIG. 9, and shows the first execution of this routine after the end of the fuel cut control. When the result at step S903 is NO, that is, when the routine being processed is not the above-mentioned first routine, the CPU 27 does not execute steps S904–S908, but instead immediately executes step S909 (FIG. 11). On the other hand, when the result at step S903 is YES, that is, when the routine being executed is the first routine after the end of the fuel cut control, the procedure proceeds to step S904.

At step S904, the CPU 27 resets the flag XFCRV to zero. Thus, steps S904–S908 are not carried out after the second execution of the routine. At step S905, the CPU 27 sets the counter CFCRV to "5", which serves as an initial value. This initial value of the counter CFCRV is the maximum count value in the counter CCRNK which will be obtained before the ignition starts after the end of the fuel cut control.

As has been described previously, the ignition starting timing changes on the basis of the ending time of the fuel injection (see FIG. 8). For example, when the first group returns to the normal ignition process at time $a_1$, the earliest ignition starting time is obtained when the end of the fuel injection falls within the period X1, and the ignition is performed at the timing (1). On the other hand, the latest ignition starting time is obtained when the end of the fuel injection falls within the period X3, and the ignition is performed at the timing (5). Thus, in order to determine the ignition timing so that it corresponds to the end of the fuel injection which varies based on the engine condition, it is necessary to detect at least the fuel injection state and the suction stroke state of each cylinder during the period between the time $a_1$ and ignition (5). This period is referred to as an ignition timing determination period. In the second embodiment being considered, the ignition timing determination period corresponds to five counts of the counter CCRNK. That is, the ignition starting timing exists within the five counts starting from time $a_1$ when the fuel cut control is terminated. As has been described previously, since the ignition starting timing varies on the basis of the end timing of the fuel injection, it is necessary to detect the end timing of the fuel injection. If this detection procedure is performed by using the counter CCRNK, there may be an identical count value during the ignition timing determination period because the counter counts up to 3 from 0 (for example, "2" in the counter CCRNK). For this reason, the counter CFCRV is provided separately from the counter CCRNK, and is initially set to "5".

Figure 10:
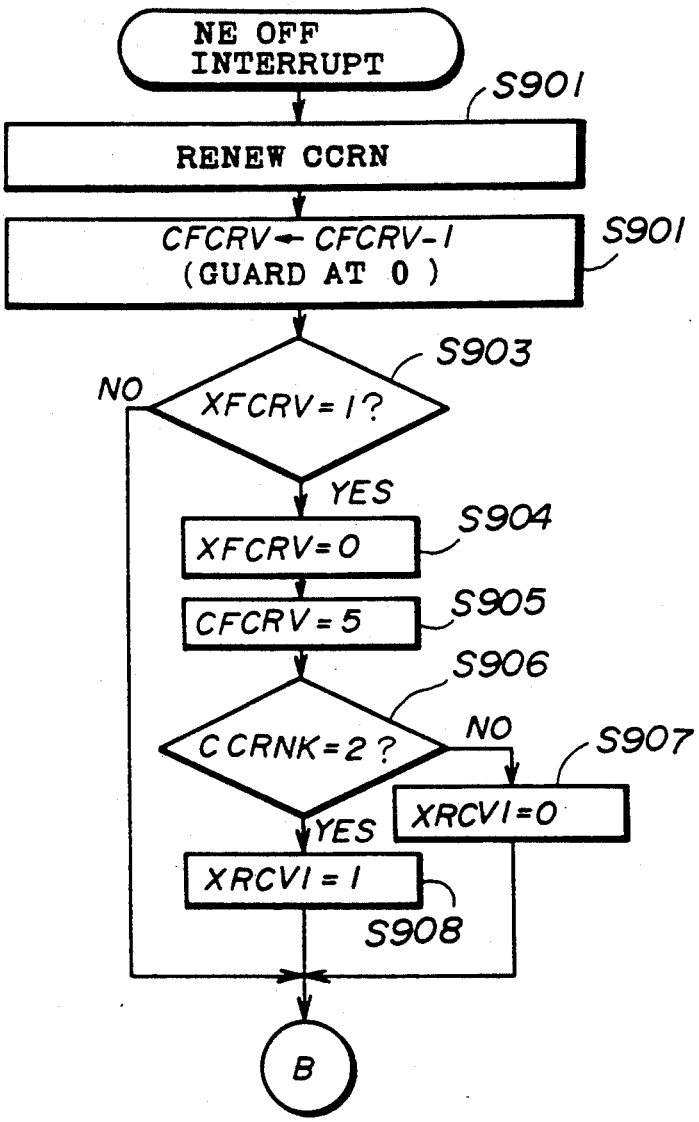
FIG. 10 is a diagram illustrating the operation of the ignition system according to the second embodiment of the present invention.
Figure 11:
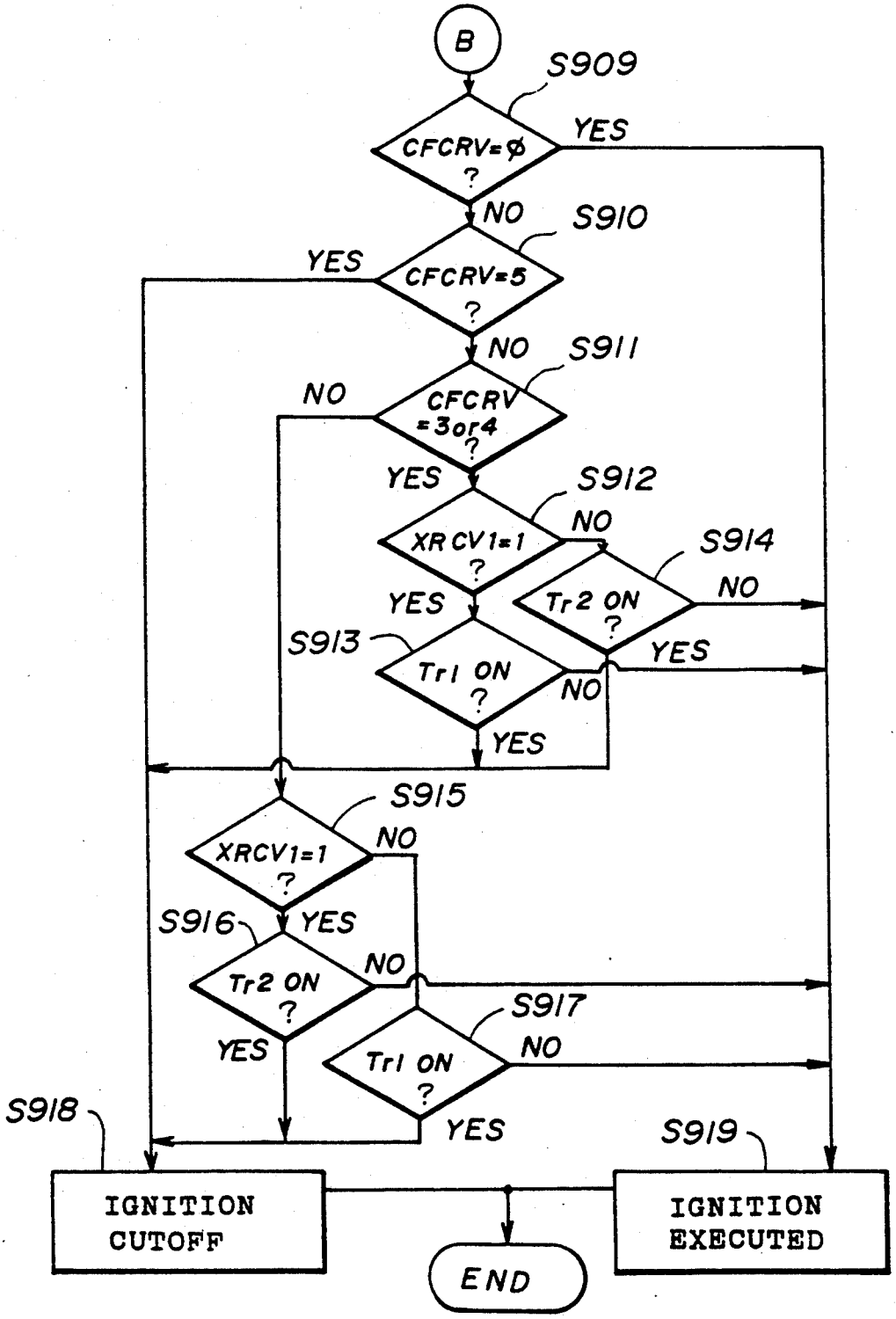
FIG. 11 is a diagram illustrating the operation of the ignition system according to the second embodiment of the present invention.

Turning now to FIG. 10, after the counter CFCRV is set to the initial value (5), the CPU 27 determines, at step S906, whether or not the current value in the counter CCRNK is equal to 2. This determination step determines whether the fuel injection after the end of the fuel cut control starts from the first group or the second group. The procedure shown in FIG. 9 is activated in response to each rise of the signal XNEON (NE ON interrupt routine), namely, for every 90° of the crankshaft angle. Thus, when the result at step S903 is YES, the value in the counter CCRNK which should be detected is equal to either 0 or 2.

Referring to FIG. 8, if the fuel injection starts at time $a_1$ related to the first group, the first fuel injection carried out for the second group starts at time $b_1$. As has described above, step S906 is executed when the result at step S903 is affirmative. That is, step S906 is executed during the first execution of the NE OFF routine shown in FIG. 10 after the end of the fuel cut control. The first fall of the signal XNEON (NE OFF) is obtained when the value in the counter CCRNK is equal to 0 or 2 after the end of the fuel cut control. As can be seen from FIG. 8, the first NE OFF related to the first group is obtained when the value in the counter CCRNK becomes equal to 2 after the fuel injection starts, and the first NE OFF related to the second group is obtained when the value in the counter CCRNK becomes equal to 0. Thus, it is possible to judge whether the fuel injection starts from the first group or the second group after the end of the fuel cut control.

When it is determined, at step S906, that the fuel injection starts from the second group after the end of the fuel cut control, at step S907 the CPU 27 resets a fuel injection start identification flag XRCV1 to 0. On the other hand, when it is determined that the fuel injection starts from the first group after the end of the fuel cut control, at step S908 the fuel injection start identification flag XFCRV1 is set to 1. Thus, it is possible to judge whether or not the fuel injection starts from the first group or the second group by referring to the fuel injection start identification flag XRCV1.

A procedure consisting of steps S909–S917 controls the ignition start timing on the basis of the value of the counter CFCRV in order to prevent the occurrence of lean combustion. At step S909, the CPU 27 determines whether or not the value in the counter CFCRV is equal to 0. When CFCRV=0, the ignition timing determination period has elapsed (see step S902), and thus a predetermined time has elapsed from the end of the fuel cut control. In this case, there is no possibility of lean combustion taking place, and it is not necessary to cut off the ignition. Thus, when it is determined, at step S909, that CFCRV=0, the CPU 27 executes step S919, at which step an advancing ignition control is carried out.

On the other hand, when the result obtained at step 909 is NO, the CPU 27 executes step S910, at which step it determines whether or not the value in the counter CFCRV is equal to 5. It will be noted that during the time the first execution of the routine is being carried out after the fuel injection starts, there is no possibility of each cylinder being filled with the amount of fuel necessary for combustion during one combustion and expansion stroke. Thus, at step S918, the CPU 27 performs the ignition cut control.

When it is determined, at step S910, that CFCRV is not equal to 5, at step S911 the CPU 27 determines whether CFCRV is equal to 3 or 4. When the result at step S911 is YES, the CPU 27 executes step S912, at which step it is determined whether or not the XRCV1=1. When it is determined that XRCV=1, that is, the fuel injection starts from the first group, the CPU 27 executes step S913, at which step the first transistor Tr1 (FIG. 13) provided for the first and second injectors 16-1 and 16-3 is ON, that is, fuel is being injected via the first and third injectors 16-1 and 16-3. When the result at step S913 is YES, lean combustion occurs in the first and third cylinders, and thus back fire may occur. For this reason, when it is determined, at step S913, that the first transistor Tr1 is ON, the CPU 27 executes step S918, at which step the first and third cylinders are not ignited (ignition cutoff).

On the other hand, when it is determined, at step S913, that the first transistor Tr1 is OFF so that the fuel injection has been completed, all fuel has been sucked into the first and third cylinders. Thus, lean combustion does not occur, and thus the CPU 27 executes step S919, at which step the first and third cylinders are fired.

When it is determined, at step S912, that XRCV1=0, that is, when the fuel injection starts from the second group, the CPU 27 executes step S914, at which step it is determined whether or not the second transistor Tr2 provided for the second and fourth injectors 16-2 and 16-4 is ON. The procedure at step S914 corresponds to that at step S913. When it is determined, at step S914, that the second transistor Tr2 is ON and thus fuel is being injected, lean combustion may occur. Thus, the CPU 27 executes step S918, at which step the second and fourth cylinders are not ignited. On the other hand, when it is determined, at step S914, that the transistor Tr2 is OFF and thus the fuel injection to the second group has been completed, there is no possibility of lean combustion occurring. Thus, the CPU 27 executes step S919, at which the second and fourth cylinders are ignited. In the above-mentioned way, the procedure consisting of steps S912–S914 can prevent the occurrence of lean combustion when CFCRV=3 or 4.

On the other hand, when it is determined, at step S911, that the value in the counter CFCRV is equal to neither 3 nor 4, that is, when it is equal to 1 or 2, the CPU 27 executes step S915, at which step it determines whether or not XRCV1 is equal to 1. When the result at step S915 is YES so that it is judged that the fuel injection starts from the first group, the CPU 27 executes step S916, at which step it determines whether or not the second transistor Tr2 is ON. The reason why the state of the second transistor Tr2 is checked when the CFCRV is equal to 1 or 2 is as explained as follows. As shown in FIG. 8, when CFCRV is equal to 1 or 2, the ignition timings ① and ② have passed, and it is thus necessary to start the ignition from the ignition timing ③.

When it is determined, at step S916, that the second transistor Tr2 is ON and thus fuel is being injected, lean combustion will occur because the amount of fuel necessary for combustion during one combustion and expansion stroke has not yet been sucked into the second and fourth cylinders. In this case, the CPU 27 executes step S918, at which step the second and fourth cylinders are not fired.

On the other hand, when it is determined, at step S916, that the second transistor Tr2 is OFF and thus the fuel injection has been completed, the second and fourth cylinders are already filled with the amount of fuel necessary for combustion. Thus, there is no possibility that lean combustion occurs. In this case, step S919 is performed.

When it is determined, at step S915, that XRCV1=1, that is, when the fuel injection starts from the second group, the CPU executes step S917, at which step it determines whether or not the first transistor Tr1 is ON. When the first transistor Tr1 is ON, step S918 is carried out. On the other hand, when it is determined that the first transistor Tr1 is OFF, step S919 is carried out. In the above-mentioned way, it is possible to prevent the occurrence of lean combustion in the case where CFCRV is 1 or 2.

In the above-mentioned first and second embodiments, the ignition control is based on the fuel cut signal output by the traction control unit 35. Alternatively, it is possible to execute the ignition control on the basis of a request generated by another device, such as an automatic transmission.

The present invention is not limited to the specifically disclosed embodiments, and variations and modifications may be made without departing from the scope of the present invention.

What is claimed is:

1. An ignition system for an internal combustion engine in which an amount of fuel necessary for combustion during one combustion and expansion stroke in one cycle of said internal combustion engine is injected toward respective cylinders, and said fuel is sucked, together with air, into said cylinders during respective suction strokes, and said internal combustion engine having a fuel cut control in which a fuel injection is cut off when said internal combustion engine is working under a predetermined condition, said ignition system comprising:

first means for igniting mixtures of fuel and air in the respective cylinders in respective combustion and expansion strokes;

second means for detecting a cylinder into which the amount of fuel necessary for combustion has not yet been sucked completely when said fuel cut control ends; and third means for controlling said first means so that the mixture of fuel and air in the cylinder detected by said second means is prevented from being ignited.

2. An ignition system as claimed in claim 1, wherein said second means comprises:

fourth means for detecting a first fuel injection timing obtained immediately after said fuel cut control starts; and fifth means for detecting a cylinder which is in the suction stroke at a predetermined time after said first fuel injection timing, and said third means comprises sixth means for preventing said first means from igniting the mixtures of fuel and air in a predetermined order starting from said cylinder detected by said fifth means.

3. An ignition system as claimed in claim 2, wherein said predetermined time corresponds to a time when fuel injected at said first fuel injection timing arrives at one of the cylinders if the fuel is actually injected at said first fuel injection timing.

4. An ignition system as claimed in claim 1, wherein said second means comprises:

fourth means for detecting a first fuel injection timing obtained immediately after said fuel cut control starts; and fifth means for detecting a crankshaft angle of a crankshaft of said internal combustion engine obtained at said first fuel injection timing, and said third means comprises sixth means for preventing said first means from igniting the mixtures of fuel and air in a predetermined order starting from a cylinder defined by the crankshaft angle detected by said fifth means.

5. An ignition system as claimed in claim 1, wherein said third means comprises means for allowing a current to pass through a primary winding of an ignition coil during a period insufficient to ignite ignition plugs provided for the respective cylinders is sequentially applied to said ignition plugs.

6. An ignition system as claimed in claim 1, further comprising:

fourth means for detecting a suction stroke in which the amount of fuel necessary for combustion has been sucked completely after the fuel cut control ends; and fifth means for making said first means start to ignite the mixtures of fuel and air in a predetermined order from a cylinder related to said suction stroke detected by said fourth means.

7. An ignition system as claimed in claim 1, further comprising:

fourth means for detecting a crankshaft angle of a crankshaft of said internal combustion engine when said fuel cut control ends;

fifth means for specifying a cylinder corresponding to said crankshaft angle detected by said fourth means; and sixth means for making said first means start to ignite the mixtures of fuel and air in a predetermined order from said cylinder specified by said fifth means.

8. An ignition system as claimed in claim 1, wherein said first means ignites the mixtures containing fuel which is simultaneously injected toward the respective cylinders.

9. An ignition system as claimed in claim 1, wherein said first means ignites the mixtures containing fuel which is simultaneously injected toward the respective cylinders twice in one cycle of said internal combustion engine.

10. An ignition system as claimed in claim 1, wherein said second means comprises:

fourth means for detecting ignition timings of said cylinders obtained before predetermined crankshaft angles of the respective combustion and expansion strokes of said cylinders; and fifth means for determining whether or not the fuel injection is completed at each of said ignition timings detected by said fourth means, and wherein said third means comprises sixth means for preventing said first means from igniting the mixture of fuel and air in each cylinder related to the respective ignition timings at which it is determined that the fuel injection is not completed.

11. An ignition system as claimed in claim 10, further comprising seventh means for controlling said first means so that said first means ignites the fixtures of fuel and air related to each cylinder related to respective ignition timings at which it is determined the fuel injection is completed.

12. An ignition method for an internal combustion engine in which an amount of fuel necessary for combustion during one combustion and expansion stroke in one cycle of said internal combustion engine is injected toward respective cylinders, and said fuel is sucked, together with air, into said cylinders during respective suction strokes, and said internal combustion engine having a fuel cut control in which a fuel injection is cut off when said internal combustion engine is working under a predetermined condition, said ignition method comprising the step of:

(a) igniting mixtures of fuel and air in the respective cylinders in respective combustion and expansion strokes;

(b) detecting a cylinder into which the amount of fuel necessary for combustion has not yet been sucked completely when said fuel cut control ends; and (c) preventing said step (a) from igniting the mixture of fuel and air in the cylinder detected by said step (b).

13. An ignition method as claimed in claim 12, further comprising the steps of:

(d) detecting a first fuel injection timing obtained immediately after said fuel cut control starts;

(e) detecting a cylinder which is in the suction stroke at a predetermined time after said first fuel injection timing; and (f) preventing said step (a) from igniting the mixtures of fuel and air in a predetermined order starting from said cylinder detected by said step (e).

14. An ignition method as claimed in claim 13, wherein said predetermined time corresponds to a time when fuel injected at said first fuel injection timing arrives at one of the cylinders if the fuel is actually injected at said first fuel injection timing.

15. An ignition method as claimed in claim 12, further comprising the steps of:

(d) detecting a first fuel injection timing obtained immediately after said fuel cut control starts;

(e) detecting a crankshaft angle of a crankshaft of said internal combustion engine at said first fuel injection timing; and (f) preventing said step (a) from igniting the mixtures of fuel and air in a predetermined order starting from a cylinder defined by the crankshaft angle detected by said step (e).

16. An ignition method as claimed in claim 12, wherein said step (c) comprises the step of allowing a current to pass through a primary winding of an ignition coil during a period insufficient to ignite ignition plugs provided for the respective cylinders is sequentially applied to said ignition plugs.

17. An ignition method as claimed in claim 12, further comprising:

(d) detecting a suction stroke in which the amount of fuel necessary for combustion has been sucked completely after the fuel cut control ends; and (e) making said step (a) start to ignite the mixtures of fuel and air in a predetermined order from a cylinder related to said suction stroke detected by said step (d).

18. An ignition method as claimed in claim 12, further comprising the steps of:

(d) detecting a crankshaft angle of a crankshaft of said internal combustion engine when said fuel cut control ends;

(e) specifying a cylinder corresponding to said crankshaft angle detected by said step (d); and (f) making said step (a) start to ignite the mixtures of fuel and air in a predetermined order from said cylinder specified by said step (e).

19. An ignition method as claimed in claim 12, wherein said step (a) ignites the mixtures containing fuel which is simultaneously injected toward the respective cylinders.

20. An ignition method as claimed in claim 12, wherein said step (a) ignites the mixtures containing fuel which is simultaneously injected toward the respective cylinders twice in one cycle of said internal combustion engine.

21. An ignition method as claimed in claim 12, wherein said step (b) comprises the steps of:

detecting ignition timings of said cylinders obtained before predetermined crankshaft angles of the respective combustion and expansion strokes of said cylinders; and determining whether or not the fuel injection is completed at each of said ignition timings detected by said step of detecting the ignition timings, and wherein said step (c) comprises the step of preventing said step (a) from igniting the mixture of fuel and air in each cylinder related to the respective ignition timings at which it is determined that the fuel injection is not completed.

22. An ignition method as claimed in claim 21, further comprising the step of controlling said first step (a) so that said first step (a) ignites the fixtures of fuel and air related to each cylinder related to respective ignition timings at which it is determined the fuel injection is completed.

* * * * *